United States Patent [19]

Takauji

[11] 4,429,605

[45] Feb. 7, 1984

[54] ELECTRONIC MUSICAL INSTRUMENT

[75] Inventor: Kiyomi Takauji, Hamamatsu, Japan

[73] Assignee: Kabushiki Kaisha Kawai Gakki Seisakusho, Japan

[21] Appl. No.: 315,982

[22] Filed: Oct. 28, 1981

[30] Foreign Application Priority Data

Oct. 28, 1980 [JP] Japan ..... 55-151123

[51] Int. Cl.[3] ..... G10H 1/08; G10H 1/36; G10H 7/00

[52] U.S. Cl. ..... 84/1.17; 84/1.19; 84/1.23

[58] Field of Search ..... 84/1.01, 1.17, 1.19–1.23

[56] References Cited

U.S. PATENT DOCUMENTS 4,273,018 6/1981 Deutsch ..... 84/1.01 X

*Primary Examiner*—Stanley J. Witkowski

*Attorney, Agent, or Firm*—McGlew and Tuttle

[57] ABSTRACT

In an electronic musical instrument which obtains waveshape amplitude values at sampling points by calculation for producing a desired waveshape, there are provided first means for calculating a waveshape varying with time and second means for calculating a waveshape undergoing no variations with time. Normally the waveshape calculation by the first means is repeated but, in the case of a new key depression or a change in the state of a tone select switch, the waveshape calculation by the second means is performed.

1 Claim, 4 Drawing Figures

ELECTRONIC MUSICAL INSTRUMENT

CROSS REFERENCE TO RELATED APPLICATION

This is related to U.S. Pat. No. 4,085,644.

BACKGROUND OF THE INVENTION

1. Field of the Invention

The present invention relates to an electronic musical instrument which is designed so that a waveshape calculation according to the Fourier calculation method is performed by switching it between the calculation of a waveshape varying with time and the calculation of a waveshape free from variations with time (which waveshape will hereinafter be referred to as a fixed waveshape), thereby to permit a rapid response to a tone variation or the like through the use of low-frequency clock pulses.

2. Description of the Prior Art

For obtaining a desired waveshape varying with time in response to the depression of a key on a keyboard, it is general practice in the prior art to calculate waveshape amplitude values at respective sample points by a waveshape calculation unit according to the Fourier calculation method. In this calculation, use is made of a system in which the waveshape calculator is activated by a change in a tone select switch such as a tablet, draw bar or the like and the states of the tone select switch and a key switch are sampled and then the waveshape calculation is conducted by the Fourier calculation method in real time. In this case, since the states of the key being depressed and the resulting tone are used as calculation elements for each calculation, the calculation period showing variations in the waveshape with time is lengthened, resulting in the likelihood of lessening the effect of a quick response to a tone variation. This can be avoided by reducing the calculation period through the use of sampling clock pulses of high frequency, but such sampling clock pulses must be subjected to high-speed processing, involving the use of expensive circuits.

SUMMARY OF THE INVENTION

It is therefore an object of the present invention to provide an electronic musical instrument which is designed to be able to rapidly respond to a tone variation or a change in the state of a key inspite of using low-frequency clock pulses.

Briefly stated, the electronic musical instrument of the present invention, which calculates waveshape amplitude values at respective sample points for obtaining a desired waveshape, is provided with first means for calculating a waveshape varying with time and second means for calculating a fixed waveshape in response to a new key depression or a change in the state of a tone select switch. Normally the first means repeats the waveshape calculation but, upon occurrence of a new key depression or a change in the state of the tone select switch, the second means is activated to perform its waveshape calculation.

DESCRIPTION OF THE PREFERRED EMBODIMENTS

According to the present invention, in the case of performing a waveshape calculation by the Fourier calculation method, information to be obtained is divided into information by the calculation of a waveform varying with time, such as depressed key information by a key and a tablet (mode I), and information by the calculation of a fixed waveshape, such as information on a tone or key-state variation (mode II). Normally, the calculation is repeated in the mode I and, as required, mode I is switched to mode II, in which the calculation is performed and, after its completion, mode I is repeated again in a new state. With this method, it is possible to quickly respond to a tone variation or key-state variation even if low-frequency clock pulses are employed.

In the case where the number of sounds simultaneously produced when depressing keys on a keyboard is N, if a time tx is needed for calculating by a waveshape calculation unit one waveshape which varies with time, then N waveshapes can be calculated in a period of time N·tx. Accordingly, the waveshape varying with time is always repeatedly calculated with a period of N·tx. If a new key is depressed during this time, then the fixed waveshape is calculated for a time tz (tz being a time related to tx) in the period N·tx. In the case of a tablet change, the fixed waveshape is calculated in a period N·tx for a time n·tz in which are calculated waveshapes of the same number n ($n \leqq N$) as the keys currently depressed.

Figure 1:
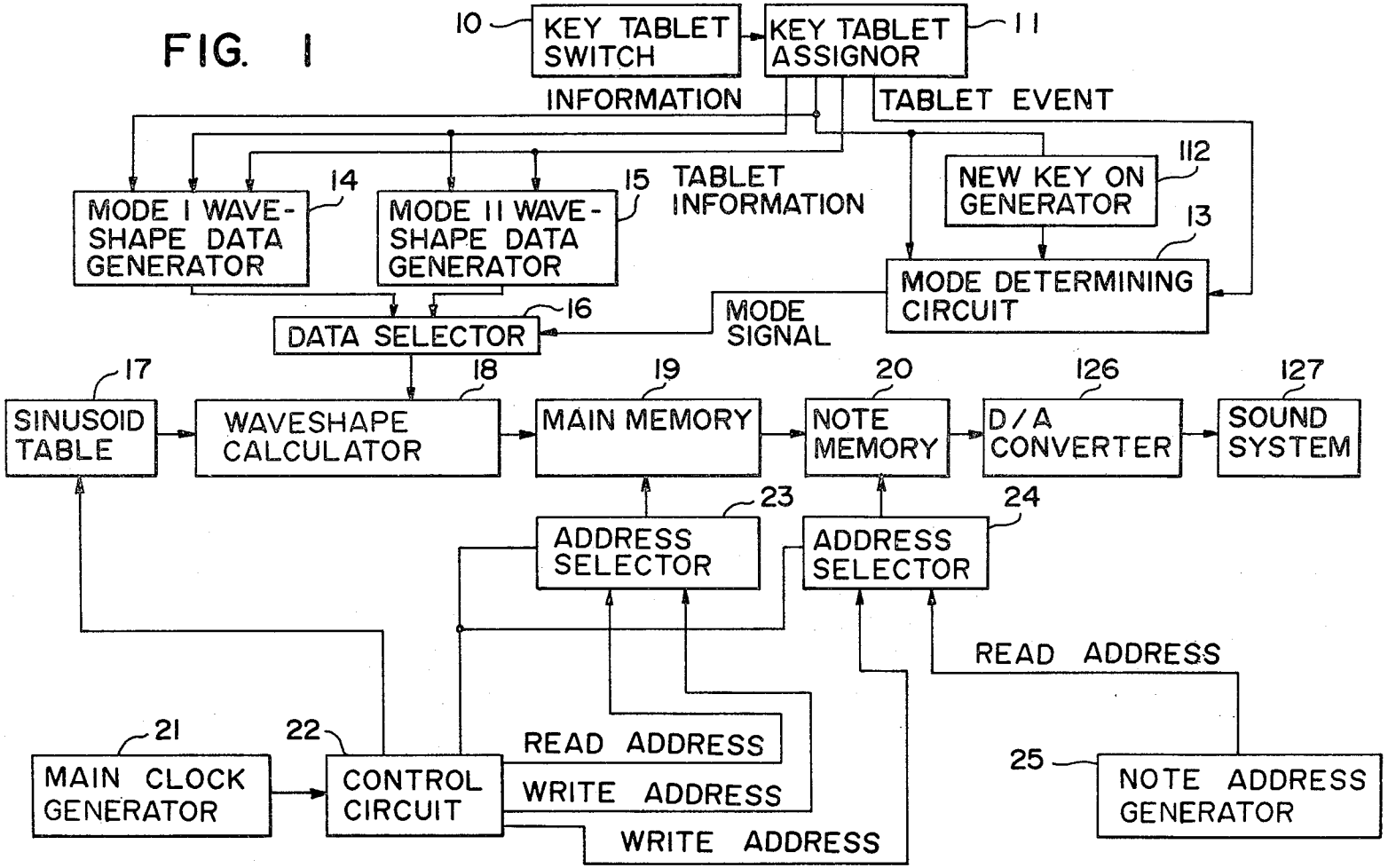
FIG. 1 is a block diagram illustrating the arrangement of an embodiment of the present invention.

FIG. 1 illustrates in block form the arrangement of an embodiment of the present invention.

The present invention is intended to achieve a smooth waveshape variation without raising the frequency of clock pulses used, by dividing the waveshape calculation into the modes I and II based on the concepts of the aforesaid U.S. Pat. No. 4,085,644 entitled "Polyphonic Tone Synthesizer".

Figure 1A:
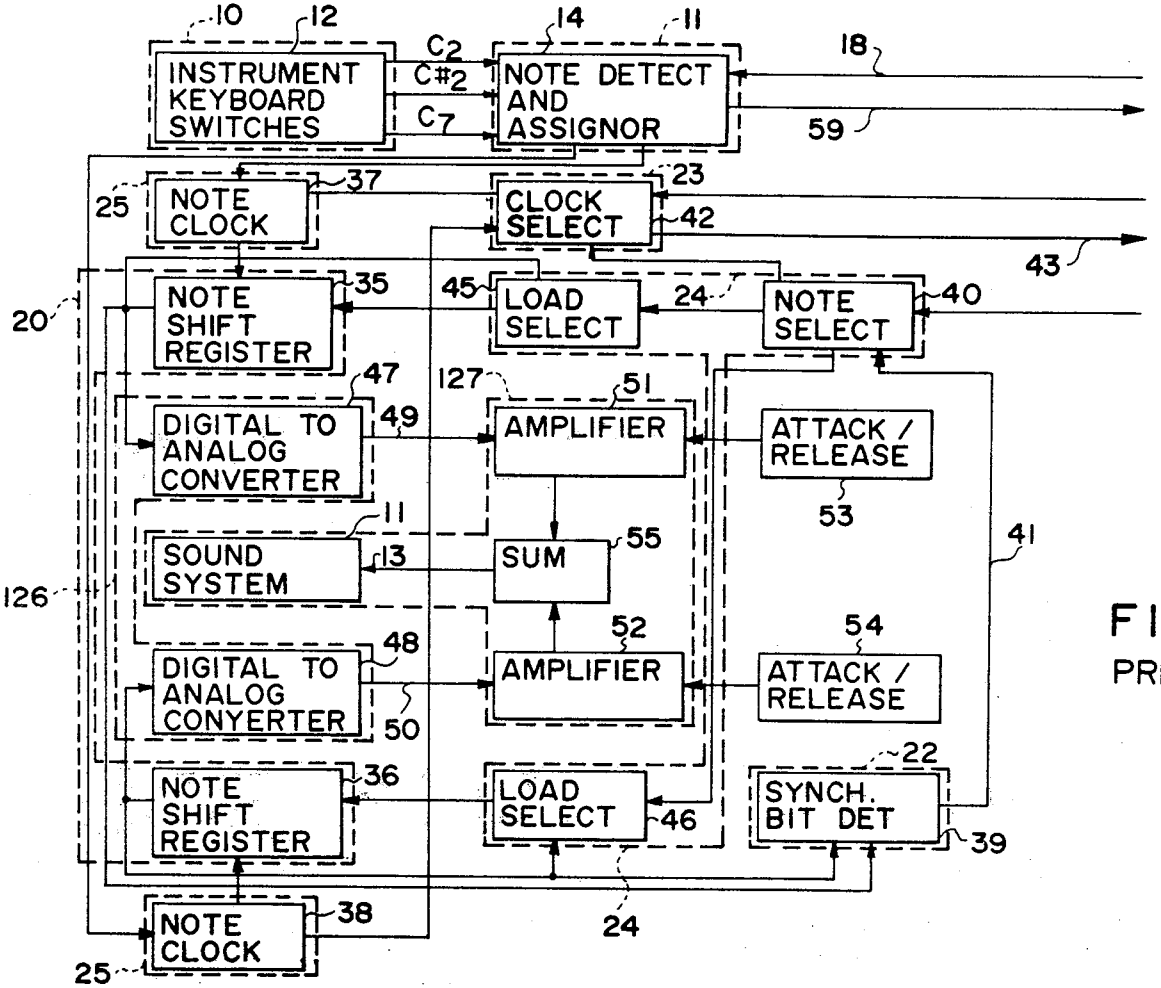
FIG. 1A PRIOR ART
FIGS. 1A and 1B are block diagrams showing the correspondence between the FIG. 1 embodiment and the aforementioned U.S. Pat. No. 4,085,644.
Figure 1B:
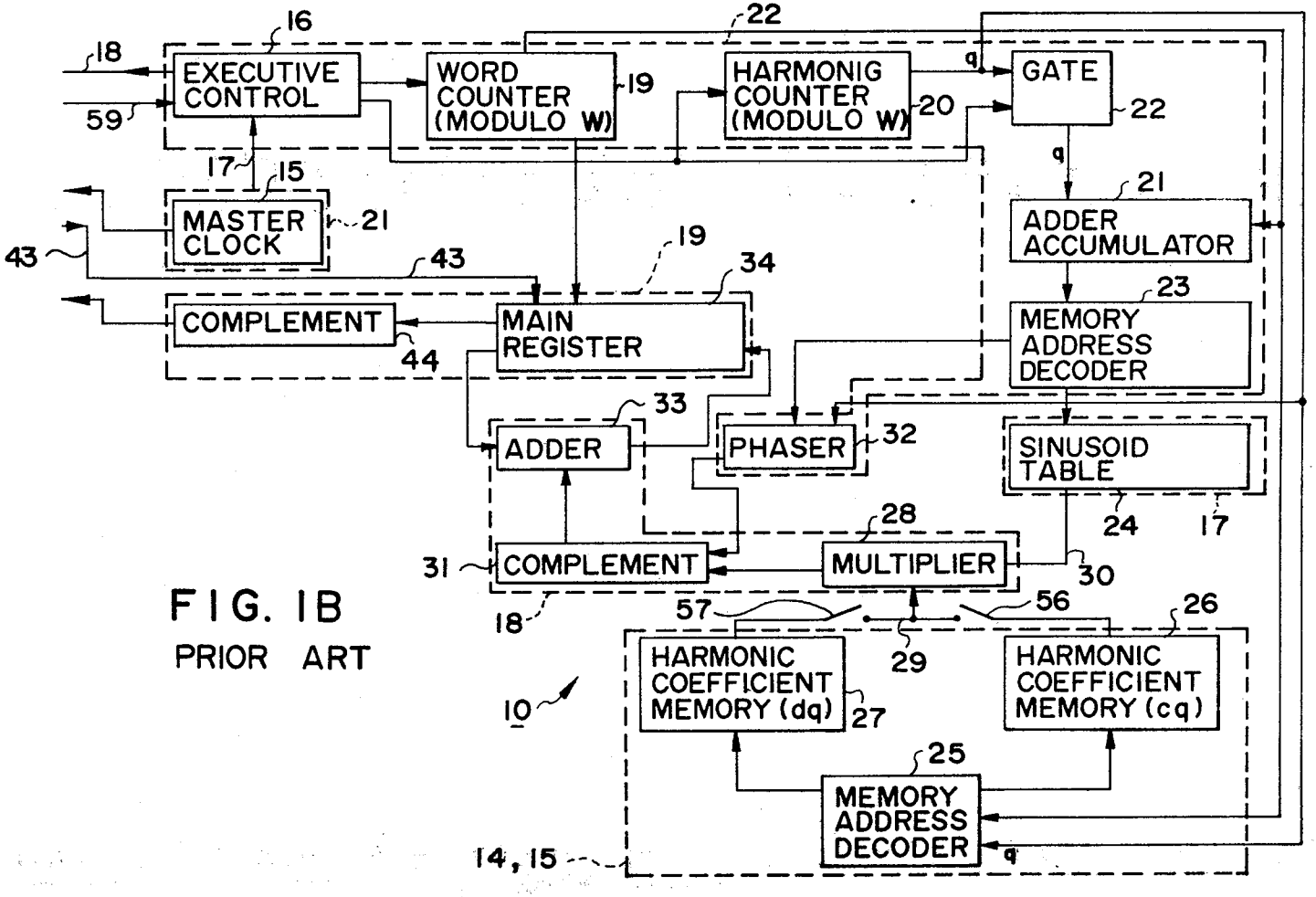
FIG. 1B PRIOR ART

FIGS. 1A and 1B show a block diagram of FIG. 1 of the above United States patent, indicating the correspondence between its block and those in FIG. 1 by marking the former with the same reference numerals as the latter. Other numerals of FIGS. 1A and 1B are used as found in the mentioned U.S. patent. The correspondence between the blocks are as follows: In FIG. 1, a key tablet switch 10 corresponds to instrument keyboard switches 12 in FIG. 1A and includes a tablet switch as well as key switches. A key tablet assignor 11 corresponds to a note detect and assignor and assigns tablet information as well as key information. A new key ON generator 112 and a mode determining circuit 13 are requisite for the present invention. A mode I waveshape data generator 14 and a mode II waveshape data generator 15 change the contents of harmonic coefficient memories 26 and 27 (FIG. 1B) with time or for each key. A waveshape calculator 18 includes a multiplier and an accumulator and multiplies each harmonic component and the sine and accumulates the multiplied value to perform a waveshape calculation. A control circuit 22 generates a timing signal for controlling the waveshape calculation and an address signal for addressing a predetermined memory area. A main memory 19 is one that allows read and write on a time-divided basis. A note memory 20 is shown by one block but has an area covering keys depressed and allows read and write on a time-divided basis. A note address generator 25 generates, as a read address, frequency information on a time-divided basis which corresponds to note clock pulses of the keys depressed.

In FIGS. 1 and 1A, the key/tablet switch 10 is a switch group including keys and tablets (which are generally tone select switches including draw bars). Signals detected by the depression of these switches are each assigned by the key/tablet assignor 11 to a time-division channel in which each key or tablet is open or closed. A key ON signal from the key/tablet assignor 11 and the output from a new key ON generator 112 which detects the key ON signal are provided to the mode determining circuit 13 to provide therefrom a mode signal with a sign representing the state of the aforesaid mode II. Otherwise, a tablet event signal from the key/-tablet assignor 11 is applied directly to the mode determining circuit 13 to derive therefrom the mode signal representing the mode II for the waveshape calculation corresponding to the key being depressed. Next, tablet information, the key ON signal and key information from the key/tablet assignor 11 are fed to the mode I waveshape data generator 14, wherein basic tone data is selected by the tablet information, data representing a waveshape variation with time is produced by the key ON signal and data for changing the waveshape is generated by the key information. These data are for calculating or synthesizing a waveshape which undergoes variations with time. Further, the tablet information and the key information from the key/tablet assignor 11 are applied to the mode II waveshape data generator 15, wherein basic tone data is selected by the tablet information and data for changing the waveshape is generated by the key information. These data are for calculating or synthesizing a fixed waveshape which undergoes no variations with time.

The outputs from the mode I and mode II waveshape data generators 14 and 15 are provided to a data selector 16, wherein a selection is made by the mode signal from the aforesaid mode determining circuit 13, whether data to be supplied to the waveshape calculator 18 will be mode I waveshape data varying with time or the mode II waveshape data which does not vary with time. In other words, the mode I waveshape data is normally provided to the waveshape calculator 18 and, when the mode signal indicates mode II, the mode II waveshape data is provided instead of the mode I waveshape data. The waveshape calculator 18 performs the waveshape calculation by the Fourier calculation method using data from a sinusoid table 17 and a harmonic coefficient selected as the output from the data selector 16. Amplitude value data synthesized at sample points calculated by the waveshape calculator 18 is applied to the main memory 19, wherein it is written by a write address signal which is produced by controlling fundamental clock pulses from a main clock generator 21 by the control circuit 22 and selecting its output by an address selector 23. At the same time, a content stored in the main memory 19 stored upon each sampling of a previously calculated waveshape is read out by a read address signal which is derived from the fundamental clock pulses from the main clock generator 21 as is the case with the abovesaid write address signal. The write and read steps are carried out on a time-divided basis. The waveshape amplitude value data read out from the main memory 19 is provided to the note memory 20, wherein it is written by a write address signal supplied from the control circuit 22 and selected by an address selector 24. Next, waveshape amplitude value data at a frequency corresponding to a scale frequency, stored in the note memory 20, is read out therefrom by a read address signal from the note address generator 25 applied thereto after being selected by the address selector 24. The waveshape amplitude value data thus read out is converted by a D-A converter 126 into an analog signal, which is supplied to a sound system 127.

Figure 2:
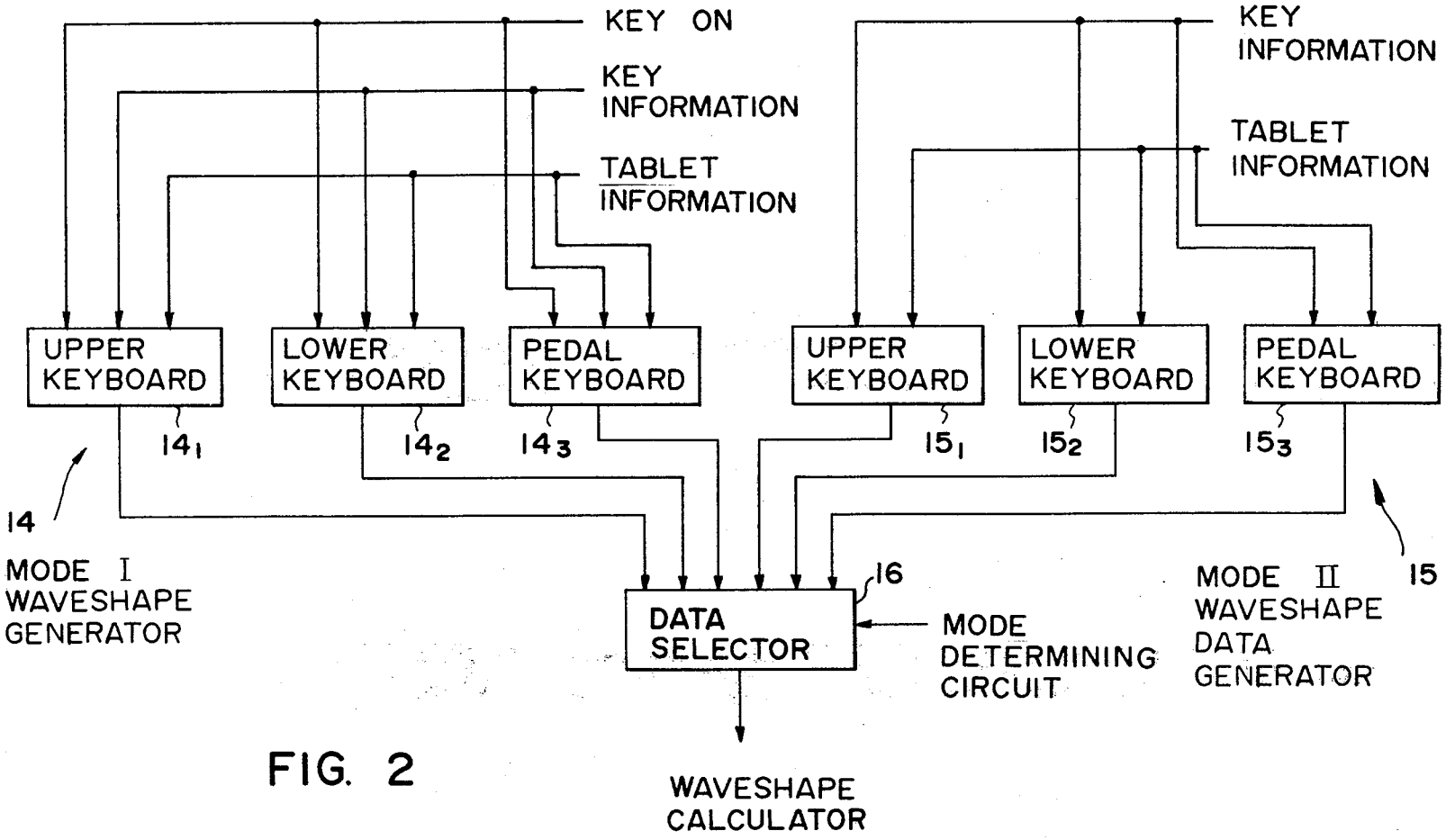
FIG. 2 is a block diagram illustrating the arrangement of another embodiment of the present invention.

FIG. 2 illustrates the arrangement of another embodiment of the present invention. In this embodiment, the mode I and mode II waveshape data generators 14 and 15 are respectively divided into upper keyboards $14_1$ and $15_1$, lower keyboards $14_2$ and $15_2$ and pedal keyboards $14_3$ and $15_3$ to increase the number of states to be detected. The operation of this embodiment is the same as that of the embodiment depicted in FIG. 1.

While in the foregoing the Fourier calculation method is employed for the waveshape calculation, other calculation methods can also be used.

As has been described in the foregoing, according to the present invention, the waveshape calculation by various methods is divided into the calculation of a waveshape which undergoes variations with time and the calculation of a waveshape which undergoes no variations with time and normally the waveshape calculation of the mode I for the waveshape varying with time is repeated with a short period and only when a new key is depressed or the state of the tone select switch changes, the waveshaped calculation of the mode II takes place. Accordingly, the present invention permits a rapid response to a new key depression or a change in the state of the tone select switch without the necessity of using sampling clock pulses of high frequency, and hence produces a musical sound similar to a natural one. Moreover, since the sampling clock pulses used may be of low frequency, the electronic musical instruments of the present invention can be constituted by highly reliable and inexpensive circuit elements.

It will be apparent that many modifications and variations may be effected without departing from the scope of the novel concepts of this invention.

What is claimed is:

1. An electronic musical instrument which is provided with a plurality of keyboards, each having a plurality of keyswitches, a plurality of tone select switches and an assignor for detecting and assigning the on-off state of the key switches and the tone select switches and in which the amplitude value at each sampling point is computed by a Fourier calculation method to obtain a desired waveshape with the output from the assignor, the electronic musical instrument comprising:

first means for synthesizing a waveshape which undergoes variations with time after the depression of one of the key switches;

second means for synthesizing, for a newly depressed one of the key switches and a key switch already depressed by a change in the on-off state of one of the tone select switches, a waveshape which does not undergo variations with time after the new key depression; and means for controlling the first and second means so that the first means repeatedly carries out a waveshape calculation and so that the second means carries out a waveshape calculation upon occurrence of one of the depression of another one of the key switches and change in the on-off state of the tone selected switches.

* * * * *